United States Patent [19]

Graf

[11] 4,387,742

[45] Jun. 14, 1983

[54] WEAVING HEDDLE FRAME

[75] Inventor: Martin Graf, Wuhrenbach, Switzerland

[73] Assignee: Grob & Co. Aktiengesellschaft, Horgen, Switzerland

[21] Appl. No.: 167,484

[22] Filed: Jul. 11, 1980

[30] Foreign Application Priority Data

Jul. 13, 1979 [CH] Switzerland ..... 6547/79

[51] Int. Cl.[3] ..... D03D 9/00

[52] U.S. Cl. ..... 139/92

[58] Field of Search ..... 139/91, 92

[56] References Cited

U.S. PATENT DOCUMENTS 2,482,149 9/1949 Blickenstorfer ..... 139/92

3,754,577 8/1973 Heller ..... 139/92

4,106,530 8/1978 Kaufmann ..... 139/92

*Primary Examiner*—Henry Jaudon

*Attorney, Agent, or Firm*—Watson, Cole, Grindle & Watson

[57] ABSTRACT

A weaving heddle frame has frame staves of light-weight construction with each stave having at least one heddle carrying rod located on one side thereof for taking up heddles with laterally open end loops. The rod has a longitudinal edge facing the frame stave and has an outwardly facing front side. A cover of a hardness which exceeds that of the rod engages the edge and side thereof and is interconnected with the rod for improving upon the resistance thereof against wear caused by the heddles.

2 Claims, 1 Drawing Figure

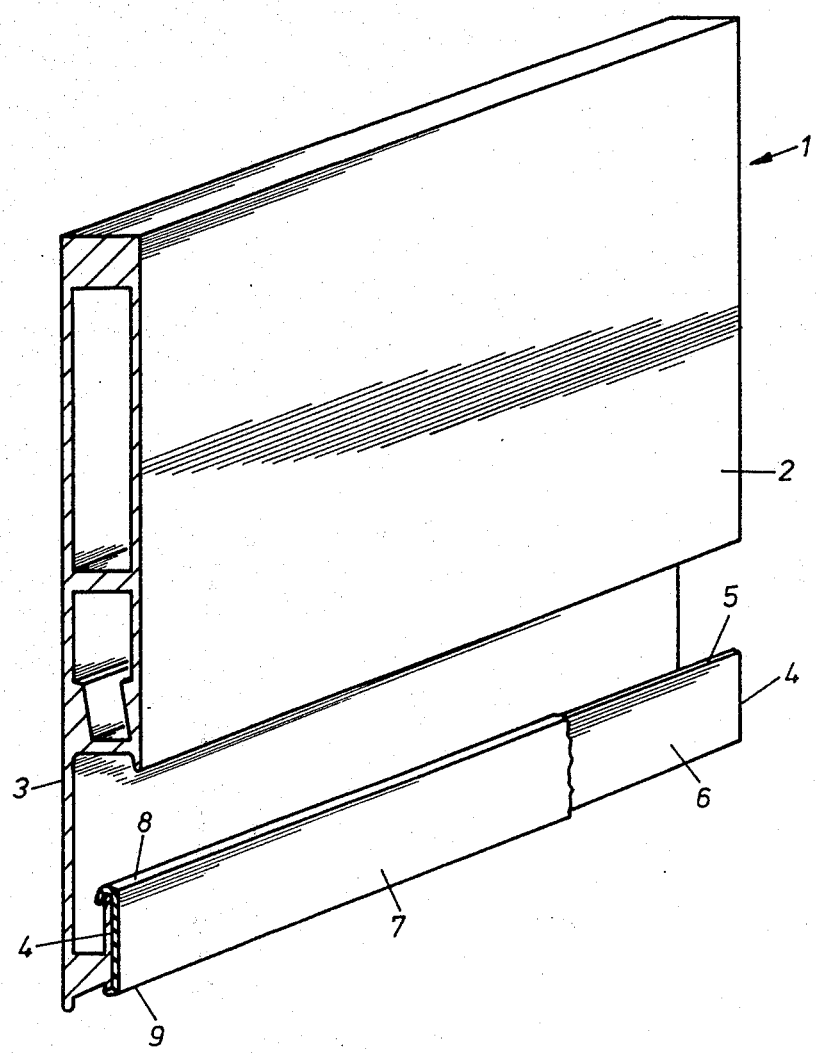
1
2
5
4
3
6
8
7
4
9

WEAVING HEDDLE FRAME

BACKGROUND OF THE INVENTION

This invention relates to a weaving heddle frame having lightweight frame staves, each frame having at least one heddle carrying rod located on one side thereof for taking up heddles with laterally open end loops.

In order to achieve a high working speed on modern weaving machines, it is essential that the heddle frame, which moves with the corresponding high frequency of strokes, be as lightweight as possible but nevertheless have the greatest possible bending strength. A high bending strength of the heddle frame, which is essential to keep the stress of the lined-up heddles within limits, could be achieved with frame staves of solid construction. However, in view of the required working speed and high frequency of strokes, it would be difficult to meet the lightweight requirement with such a solid construction. Heddle frames have therefore been made of lightweight construction including frame staves and heddle carrying rods for the heddles forming a single unit and being manufactured of the same material, the frame staves being of hollow construction. The heddle frames may be of light metal or of synthetic material which may be reinforced by fibers or webs.

With frame staves of the aforementioned type, forming a single unit with heddle carrying rods for the heddles, a sufficient resistance to wear and tear cannot however be achieved if, at each stroke of the heddle frame, the heddles with metallic end loops strike against the heddle carrying rod made of a softer material.

SUMMARY OF THE INVENTION

It is therefore an object of the present invention to provide a lightweight heddle frame of the aforedescribed type wherein the longitudinal edge of the rod facing the frame stave and the outwardly facing front side of the rod are covered with harder material than the heddle carrying rod, the cover being interconnected with the heddle carrying rod. This cover may comprise a plate of hardened sheet material and may be adhesively interconnected with the heddle carrying rod. And, the cover may have a substantially U-shaped rim overlapping the longitudinal edge of the rod and may have an angled edge overlapping the opposite edge of the heddle carrying rod to otherwise facilitate a snapping of the cover in place.

By covering the heddle carrying rod in such manner the heddle frame of lightweight construction is provided the necessary resistance to wear and tear at the decisive region, and by gluing the different materials together an increased bending strength as well as a reduction of noise developments can be achieved, since by connecting two materials with different modulus of elasticity, the natural vibration of the connected body is reduced.

Other objects, advantages and novel features of the invention will become more apparent from the following detailed description of the invention when taken in conjunction with the accompanying drawing.

DETAILED DESCRIPTION OF THE INVENTION

The single drawing FIGURE is a section of a frame stave having its heddle carrying rod covered by a plate of sheet metal, as in accordance with the present invention.

Frame stave 1, of either a light-metal or synthetic hollow construction, has a front wall 2 and an elongated back wall 3, a heddle carrying rod 4 for the heddles being molded on one side of the back wall. This back wall, therefore, supports the heddle carrying rod in such a manner that its front side is free to support heddles with laterally open end loops which may be of the type disclosed in copending application Ser. No. 167,485, filed July 11, 1980, now U.S. Pat. No. 4,342,339 and commonly owned herewith.

Heddle carrying rod 4 has a longitudinal edge 5 facing frame stave 1, and has an outwardly facing front side 6. Edge 5 and side 6 are covered by a plate of sheet metal 7 having a rim 8, substantially U-shaped in cross-section, which overlaps edge 5. Cover 7 also has an angled rim 9 which overlies the opposite edge of heddle carrying rod 4. This cover has a hardness of 45 to 50 Rockwell and is harder than the metallic end loops of the heddles that will be lined up on the heddle carrying rod, and is likewise harder than that of the heddle carrying rod itself. The plate thickness of cover 7 is preferably 0.2 to 0.3 mm which renders it inherently flexible, and the cover may be adhesively secured to the heddle carrying rod. Otherwise, angled rim 9 can be designed for permitting the cover to be snapped in place on the heddle carrying rod. The cover may thus be easily interchanged when necessary.

Alternatively, a double-row heddle frame (not shown) may be provided as having two heddle carrying rods thereon, back-to-back, at one side of the back wall of the frame stave, with each heddle carrying rod being covered by a plate of sheet metal such as 7.

Other objects, advantages and novel features of the present invention are made possible in the light of the above teachings. It is therefore to be understood that within the scope of the appended claims the invention may be practiced otherwise than as specifically described.

What is claimed:

1. A heddle frame including frame staves of lightweight construction and of a predetermined hardness, each said frame stave having a front wall and having a back wall which includes an extension beyond a side edge of said front wall, a heddle carrying rod integrally connected with said back wall and being of the same lightweight construction and predetermined hardness as said frame stave, said rod having a longitudinal edge confronting said side edge of said front wall and having an outwardly facing front side, and said rod being disposed on one surface of said back wall extension for supporting heddles with laterally open end loops, a removable cover comprising a thin flexible plate of sheet metal in contact with said front side of said rod and engaging said longitudinal edge thereof, said cover having a hardness greater than the hardness of said rod and having a substantially U-shaped rim overlapping said longitudinal edge of said rod and engaging a back side of said rod, said cover having an angled rim in engagement with an edge of said rod lying opposite said longitudinal edge for permitting said cover to be snapped in place on said rod upon engagement of said U-shaped rim with said back side of said rod, whereby said cover provides resistance to rod wear caused by the heddles.

2. The heddle frame according to claim 1, wherein said cover has a plate thickness of 0.2 to 0.3 mm and a hardness of 45 to 50 Rockwell.

* * * * *